United States Patent [19]

Hasselström

[11] Patent Number: 4,723,999

[45] Date of Patent: Feb. 9, 1988

[54] METHOD OF POWDER METALLURGICALLY MANUFACTURING AN OBJECT

[75] Inventor: Per Hasselström, Norrtälje, Sweden

[73] Assignee: Uddeholm Tooling Aktiebolag, Hagfors, Sweden

[21] Appl. No.: 28,665

[22] Filed: Mar. 20, 1987

[30] Foreign Application Priority Data

Mar. 21, 1986 [SE] Sweden ..... 8601323

[51] Int. Cl.[4] ..... C22C 29/02

[52] U.S. Cl. ..... 75/236; 75/242; 75/246; 419/49

[58] Field of Search ..... 419/49; 75/236, 242, 75/246

[56] References Cited

U.S. PATENT DOCUMENTS

| | | | |
|---|---|---|---|
| Re. 28,301 | 1/1975 | Havel | 419/49 |
| 4,428,906 | 1/1984 | Rozmus | 419/49 |
| 4,601,877 | 7/1986 | Fujii et al. | 419/49 |
| 4,656,002 | 4/1987 | Lizenby et al. | 419/49 |

FOREIGN PATENT DOCUMENTS

| | | |
|---|---|---|
| 0061988 | 10/1982 | European Pat. Off. . |
| 2444523 | 7/1980 | France . |
| 2455940 | 12/1980 | France . |
| 425361 | 9/1982 | Sweden . |
| 435272 | 9/1984 | Sweden . |
| 1190123 | 4/1970 | United Kingdom . |

OTHER PUBLICATIONS

"Metals Handbook", vol. 7, 1984, pp. 784–788.

*Primary Examiner*—Stephen J. Lechert, Jr.

*Attorney, Agent, or Firm*—Murray and Whisenhunt

[57] ABSTRACT

A method of powder metallurgically manufacturing an object is disclosed, wherein placing a first powder (4) selected from the group consisting of a metal powder, a mixture of metal powders, a metal alloy powder, a metal alloy mixture, a mixture of metal powder or metal alloy powder and fibres, particulate ceramic materials, and or other particulate material, and mixtures thereof, in an open mould (1), embedding the mould filled with first powder in a powdered pressure medium (8) made of a material which has a melting point less than the melting point of said first powder or less than the melting point of a component in said first powder which has the lowest melting point, said pressure medium essentially not evaporating at the consolidation temperature of said first powder, melting and pressure medium, raising the temperature of the first powder to a temperature between the liquidus and solidus temperatures of the metal or alloy from which the first powder is manufactured, or, if the first powder is a mixture of two or more dissimilar powders, to a temperature between the solidus temperature of the powder which has the lowest solidus temperature and the resulting liquidus temperature for the mixture, and subjecting the melted pressure medium (8') to an isostatic pressure of between 1 and 100 bar to consolidate said first powder to a completely dense body by pressure transfer through the melted pressure medium.

10 Claims, 1 Drawing Figure

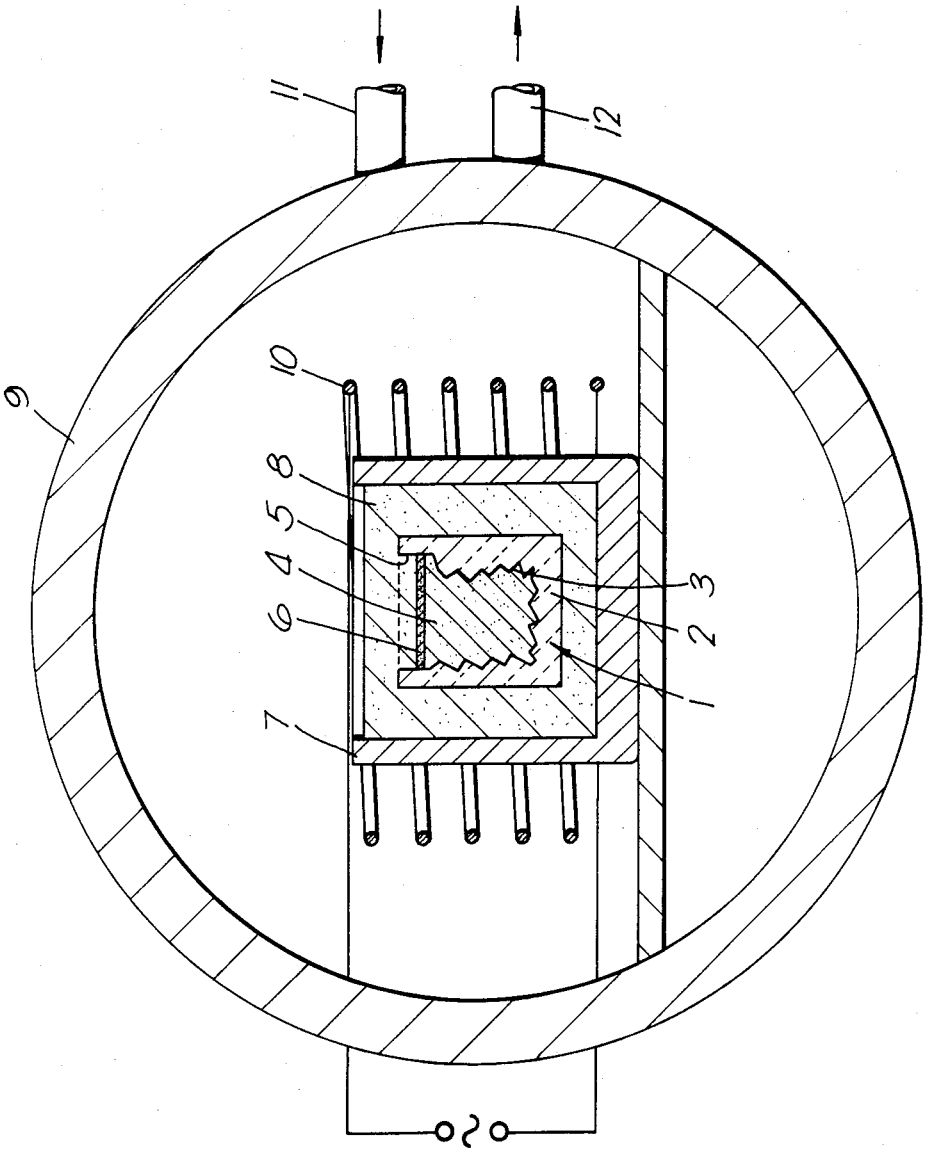
11
12
9
10
8
5
4
6
7
3
2
1

METHOD OF POWDER METALLURGICALLY MANUFACTURING AN OBJECT

BACKGROUND OF THE INVENTION

Great efforts have during a long period of time been devoted to research and development for the purpose of avoiding casting and subsequent machining in the manufacturing of i.a. superalloys, high speed steel, high alloyed tool steels, and other alloys which, because of their micro structures and tendencies to segregation, are difficult to cast and/or difficult to machine. One can see two principle lines in the course of this development, which both are based upon a powder metallurgical technique, namely on one hand powder compacting in the solid phase, e.g. hot isostatic pressing (HIP) and on the other hand consolidation of powder in the two-phase region, liquid phase/solid phase, often to finished shape.

DESCRIPTION OF THE INVENTION

The present invention relates to the two-phase region consolidation, which, as compared with powder compacting in solid phase, is faster and does not require sophisticated equipment.

According to the invention metal powder, or a metal powder mixture, or a mixture of metal powder and ceramic powder, fibres and/or other fine particulate ingredients, are placed into a mould which has a mould surface corresponding to the desired shape of the object to be manufactured. Preferably the mould consists of a precision cast ceramic mould. The ceramic mould by way of example can in turn be precision cast in a mould made of silicon rubber.

Preferably the ceramic mould is manufactured of a moist paste, the solid content of which mainly consists of aluminum oxide ($Al_2O_3$) containing a minor amount of a binding agent consisting of slaked lime (CaO). The content of aluminum oxide may be between 90 and 98%, while the quantity of binding agent, i.e. the lime content, should be between 2 and 10%.

The silicon rubber mould in its turn may be manufactured by copying casting upon a shrinkage compensated model.

The casting mould is open. The metal powder, by way of example may, consist of a steel powder or of a mixture of two or more powders having different alloy compositions. The metal powder can also be covered by a thin layer of another material, e.g. very fine grain graphite. The metal powder can also completely or partly be replaced by a fine particulate material in fibre form or by fine particulate ceramic materials and/or other fine particulate ingredients. For the sake of simplicity the comprehensive term metal powder will be used in this text, whether the material consists of powder or fibres, or consists of one or more metals or alloys or of a composite composition.

The mould filled with metal powder is placed in an outer container and covered by a thin, about 3–10 mm thick, layer of a fine grain boron nitride or other material which can act as a barrier against the pressure medium which is used according to the invention. The mould together with its content thereafter is placed in an outer container and embedded in a pressure medium which consists of a powder of a material which is solid at room temperature but liquid at the consolidation temperature of the metal powder, and which is essentially not evaporized at this temperature. Glass is an example of a suitable pressure medium. Another conceivable material is lead. Thereafter the temperature is raised so that the glass powder or corresponding pressure medium is melted. The temperature of the metal powder is raised further to a temperature between the liquidus and solidus temperatures for the metal or alloy of which the metal powder is made, or to a temperature between the solidus temperature for that powder grade which has the lowest solidus temperature and the resulting liquidus temperature for the mixture if two or more powder grades are mixed.

When the desired temperature of the metal powder has been achieved the melted pressure medium, i.e. the melted glass or corresponding medium, is subjected to an isostatic pressure amounting to between 1 and 100 bar, with the pressure being transferred to the heated powder body via the melted pressure medium. The pressure is maintained for so long a period of time to cause the powder body to be consolidated to a completely dense body. At the same time, the melted pressure medium, by pressing against the outside of the mould, prevents the comparatively brittle ceramic mould from being cracked or broken to pieces. The consolidation is performed fast as the metal powder at temperatures between the liquidus and solidus temperatures of the metal powder is in a two-phase region (melt/solid phase) in which the material is readily formable.

As has been mentioned above, the mould, which contains the metal powder, suitably is placed in an outer container, with the space between the mould and the outer container being filled with the initially powdery pressure medium. The outer container may consist of steel or other metal or of graphite or ceramic. As it is open it will be subjected to an equilateral compacting pressure, i.e. a compacting pressure which is equal from all sides, and therefore it need not be particularly strong. The outer container thereafter is placed in a pressure vessel provided with internal heated elements. Prior to heating the initially powdery pressure medium, i.e. glass powder or corresponding material, for melting said medium, the air is pumped out from the pressure vessel and its interior is preferably flushed by means of an inert or reducing protective gas, e.g. nitrogen. Prior to melting the pressure medium, the protective gas is also evacuated, so that subatmospheric pressure prevails in the pressure vessel during the heating phase.

The heating temperature of the metal powder depends on its chemical composition. When the powder consists of a highly alloyed steel alloy for the manufacturing of moulding tools or industrial cutting tools with near net shape, e.g. high speed tools, the heating is suitably performed to a temperature between 1200° and 1450° C., e.g. to about 1335° C.

In order not to press the glass melt into the metal powder in the open mould, the metal powder is suitably covered by a barrier layer preventing the molten glass from penetrating into the metal powder. This barrier layer, by way of example, may consist of a layer of boron nitride, $Al_2O_3$, graphite, and other conceivable material in powder form.

DESCRIPTION OF THE DRAWING

The invention will be explained more in detail in the following with reference to the drawing which schematically illustrates the preferred embodiment.

DESCRIPTION OF PREFERRED EMBODIMENT

In the drawing, a ceramic crucible 1 has a mould cavity 2 with an internal surface 3 made by precision copying casting. The mould cavity 2 is filled with metal powder 4 made of that metal, alloy or composite, from which the object which is to be manufactured, is to be composed. The powder body 4 may consist of a powder mixture consisting of two or more alloys having different liquidus temperatures and/or contain other particulate materials, as mentioned above. The opening 5 of the mould 2 is filled with a thin—approximately 3 to 10 mm thick—layer 6 of fine grain boron nitride, which is wetted very poorly by glass and which therefore will act as an effective barrier layer which prevents the molten glass from penetrating down into the metal powder 4. As an alternative the barrier layer 6 may consist of powdered aluminum oxide $Al_2O_3$ which can combine chemically with molten glass to form a high temperature melting compound which by freezing can act as a barrier against continued penetration of glass.

The crucible 1 is placed in an outer crucible 7, which is filled with glass powder 8 so that all sides of the crucible 1, including the upper side with the boron nitride barrier layer 6, is completely embedded in the glass powder. The outer crucible 7, with its content of glass powder 8, the crucible 1 embedded in the glass powder, and with the metal powder 4 in the mould cavity 2, in its turn is placed in a pressure vessel 9 having internal heating elements 10 and connection conduits 11 and 12 for the evacuation of gas from the interior of the vessel 9 and for flushing with gas and also for feeding gas under overpressure of about 10 bar into the pressure chamber.

EXAMPLE OF THE INVENTION

The manufacturing of an object by the process of the present invention may be performed in the following manner by means of the described apparatus. Gas atomized metal powder 4, which was high speed steel powder for the manufacturing of hob blank having the composition shown in Table 1 was poured into the precision cast ceramic mould 1. Thereafter the layer 6 of boron nitride or aluminum oxide (the layer 6 is 2–6 mm thick) was provided above the metal powder 4 which was packed gently. The crucible 1 was embedded in the glass powder 8 in the outer crucible 7, and the resulting assembly was placed in the oven 9. After flushing with protective gas, suitably nitrogen, and subsequent evacuation of the protective gas the glass powder 8 was heated until it was melted. Thereafter the heating was continued at a rate of about 5° C./min until a temperature of 1000° C. was reached. In order to equalize the temperature the sample may be kept at 1000° C. for a predetermined holding time, the duration of which will depend on the dimensions of the object intended to be manufactured. Thereafter the temperature was further increased until it reached a point between the liquidus and solidus temperatures for the metal or alloy of which the metal powder 5 was manufactured. As an alternative, in the case when operating with a mixture of powders having different liquidus temperatures, the temperature is raised to a temperature where one of the alloys is liquid and another alloy is in the solid state. In this example the final temperature is shown in Table 2.

When the desired temperature had been achieved, argon was supplied under overpressure shown in Table 2 into the oven 9, which is dimensioned as a pressure vessel. Due to the high plasticity of the metal powder 4 or the metal powder mixture in the two-phase region (liquid/solid phase), the powder was consolidated to a completely dense body by the fact that the gas pressure in the oven 9 was transferred to the metal powder body via the melted glass powder 8' and the boron nitride layer 6 or other corresponding barrier layer, thereby compacting the metal powder 4 in the mould cavity 2.

The foregoing description of the manufacturing technique only is one example of how the invention can be performed. It should be understood that temperatures, holding times and pressures are dependent of one another, and also have to be adapted to that or those metals or alloys of which the metal powder or the metal powder mixture respectively, is manufactured, and also has to be adapted to the dimensions of the object which shall be manufactured.

Two different powder grades were tested for the manufacturing of high speed steel tools in a couple of experiments:

TABLE 1

| | % C | % Si | % Mn | % Cr | % Mo | % W | % V | % Co |
|---|---|---|---|---|---|---|---|---|
| A | 4.28 | 0.79 | 0.24 | 3.4 | 12.9 | 13.9 | 15.0 | 0.02 |
| B | 1.33 | 0.21 | 4.76 | — | 5.0 | 6.12 | 3.05 | — |

Balance iron, impurities and accessory elements in normal quantities.

In one experiment there was used a sieved fraction <45 μm of powder A. In other experiments with powder A there was used a sieved fraction between 45 and 250 μm. Powder B had a sieved grainsize <250 μm.

In the experiments the following powders, temperatures and pressures were used:

TABLE 2

| Test No. | Powder grade | Max temp. | Pressure |
|---|---|---|---|
| 1 | A (45–250 μm) | 1290 | 5–10 bar |
| 2 | B (<250 μm) | 1370 | ~10 bar |
| 3 | A (<45 μm) | 1330 | ~10 bar |
| 4 | A (45–250 μm) | 1330 | ~10 bar |
| 5 | A (45–250 μm) | 1330 | 1 bar |

Due to their very different alloying compositions the two powder grades A and B performed very differently at the high temperatures where the consolidation was performed. The tests which have been carried out, however, indicate that it is possible to achieve very fine surfaces, but that a fine grain powder seem to give better surfaces than a coarser one. The tests also indicate that over-eutectic steels, i.e. steels in which carbides are precipitated in the melt and the metallic phases are formed on the carbides during the solidification, like the steel of powder A, seem to be preferably before under-eutectic steels in order to prevent any significant precipitation of carbides in the grain boundaries during the solidification.

I claim:

1. A method of powder metallurgically manufacturing an object comprising (A) providing a first powder, said first powder being a metal powder or a mixture of metal powders, said metal powder having a melting point, said mixture of metal powders having a component having a lowest melting point of said mixture of metal powders, said metal powder having a liquidus temperature and a solidus temperature, said mixture of metal powders having a component having a lowest solidus temperature and a liquidus temperatus for said mixture of metal powders;

(B) providing a ceramic mould, said ceramic mould having an interior receivable of said first powder, said interior having precision copy cast surfaces, said mould having an opening providing access to said interior, said opening being at least as large as any cross section of the mould interior parallel with the opening;

(C) placing said first powder in said mould interior;

(D) embedding said mould containing said first powder in a second powder, said second powder being meltable to form a pressure transmitting medium, said second powder having a melting point less than said melting point of said metal powder or less than said melting point of said component having said lowest melting point of said mixture of metal powders, said pressure transmitting medium not evaporating at a consolidation temperature of said metal powder or said mixture of metal powders;

(E) melting said second powder to form a pressure transmitting medium;

(F) raising the temperature of said first powder to a temperature between said liquidus temperature and said solidus temperature for said metal powder, if said first powder is said metal powder, or, to a temperature between said solidus temperature of said component having said lowest solidus temperature and said liquidus temperature for said mixture of metal powders, if said first powder is said mixture of metal powders; and (G) subjecting said pressure transmitting medium to an isostatic pressure of between 1 and 100 bar to consolidate said first powder in said mould to a completely dense body having an exterior shaped by said precision copy cast surfaces of said interior of said mould;

whereby said isostatic pressure is transmitted to said first powder by said pressure transmitting medium through said opening in said mould without deformation of said mould since said mould is subjected uniformly to said isostatic pressure.

2. The method according to claim 1, wherein gas in the spaces between the particles of said first powder is evacuated prior to the melting of said second powder to form a pressure transmitting medium, so that said pressure transmitting medium thereafter functions as a seal against an underpressure in the body of said first powder.

3. The method according to claim 1, wherein a barrier layer is provided between said first powder and said pressure transmitting medium, said barrier layer pressing against said first powder under the influence of said pressure transmitting medium, but preventing penetration of said pressure transmitting medium into said first powder.

4. The method according to claim 3, wherein said barrier layer comprises a powder or mixture of powders having a melting temperature higher than said first powder.

5. The method according to claim 4, wherein said barrier layer is boron nitride, aluminum oxide or graphite.

6. The method according to claim 1, wherein said first powder is a steel powder having an over-eutectic composition, thereby preventing carbide from precipitating in the grain boundaries during solidification.

7. The method according to claim 1, wherein said first powder is a mixture of two or more metal or alloy powders having different chemical compositions and different liquidus temperatures.

8. The method according to claim 1, wherein said second powder is glass powder.

9. An article produced by the process according to claim 1.

10. The article according to claim 9, wherein said first powder is a steel powder having a composition such that carbides are not essentially melted at the consolidation.

* * * * *